US005346516A

United States Patent [19]

Alkhas et al.

[11] Patent Number: 5,346,516

[45] Date of Patent: Sep. 13, 1994

[54] NON-WOVEN ABRASIVE MATERIAL CONTAINING HYDROGENATED VEGETABLE OILS

[75] Inventors: Robinette S. Alkhas, Rancho Cucamonga; Michael Salyards, Hesperia, both of Calif.

[73] Assignee: Tepco, Ltd., Phelan, Calif.

[21] Appl. No.: 122,762

[22] Filed: Sep. 16, 1993

[51] Int. Cl.[5] ..... B24B 1/00

[52] U.S. Cl. ..... 51/296; 51/293; 51/295; 51/298; 51/304

[58] Field of Search ..... 51/293, 295, 296, 298, 51/304

[56] References Cited

U.S. PATENT DOCUMENTS

| | | | |
|---|---|---|---|
| 2,958,593 | 11/1960 | Hoover et al. | 51/295 |
| 3,401,491 | 9/1968 | Schnabel et al. | 51/295 |
| 3,688,453 | 9/1972 | Legacy et al. | 51/400 |
| 4,011,063 | 3/1977 | Johnston | 51/296 |
| 4,018,575 | 4/1977 | Davis et al. | 51/295 |
| 4,227,350 | 10/1980 | Fitzer | 51/298 |
| 4,314,827 | 2/1982 | Leitheiser et al. | 51/298 |
| 4,331,453 | 5/1982 | Dau et al. | 51/298 |
| 4,355,489 | 10/1982 | Heyer et al. | 51/460 |
| 4,364,746 | 12/1982 | Bitzer et al. | 51/296 |
| 4,486,200 | 12/1984 | Heyer et al. | 51/295 |
| 4,609,380 | 9/1986 | Barnett et al. | 51/298 |
| 4,802,896 | 2/1989 | Law et al. | 51/298 |

OTHER PUBLICATIONS

Bisht et al., "Vegetable Oils as Lubricants and Additives", *Journal of Scientific and Industrial Research,* vol. 48, Apr. 1989, pp. 174–180.

"Bear-Tex Products Standard Stock Catalog", Catalog No. 400, Norton Co., Worchester, Mass. (Feb. 1993).

*Primary Examiner*—Mark L. Bell
*Assistant Examiner*—Willie J. Thompson
*Attorney, Agent, or Firm*—Nilsson, Wurst & Green

[57] ABSTRACT

A non-woven abrasive material including a lofty, open, three dimensional web of non-woven fibers randomly intertwined and carrying abrasive particles and a binder material bonding the fibers together and bonding the abrasive particles to the fibers, with hydrogenated vegetable oil in solid form coating the fibers, particles and binder material at the surface of the web and within voids in the interior of the web, and preferably also with a coating of resinous plastic binder encapsulating the hydrogenated vegetable oil at the surface of the web and within its interior.

26 Claims, 1 Drawing Sheet

FIG. 1
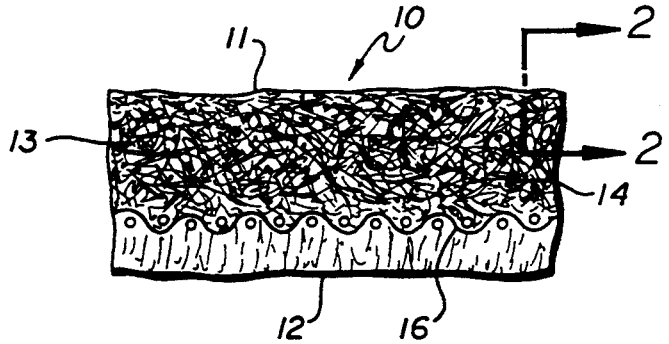
FIG. 2
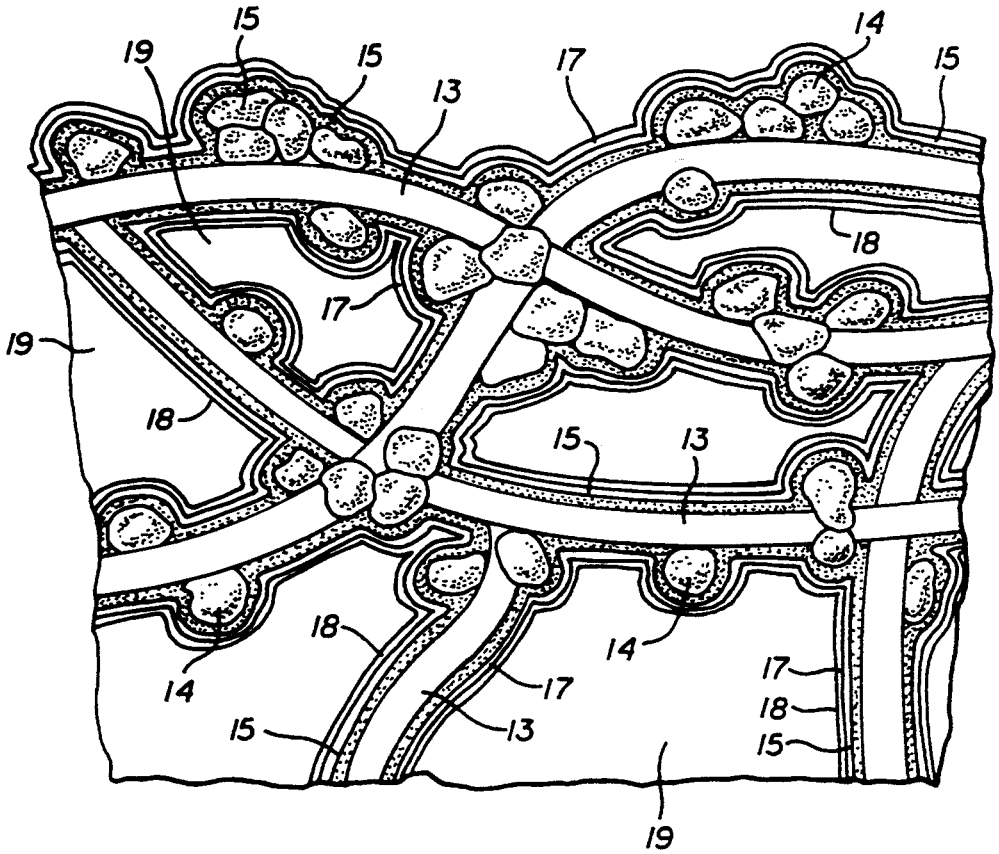
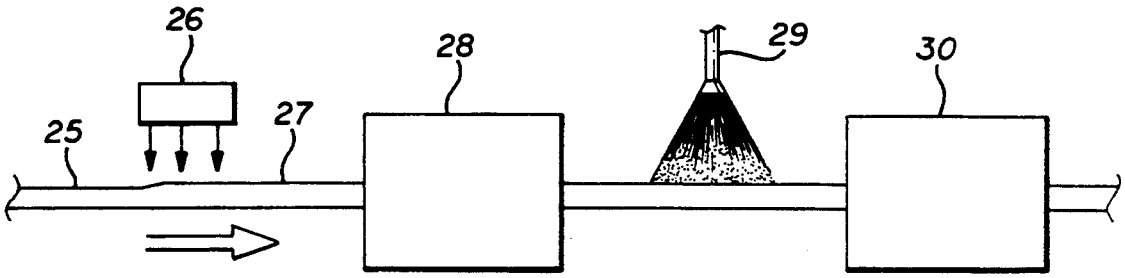
FIG. 3

NON-WOVEN ABRASIVE MATERIAL CONTAINING HYDROGENATED VEGETABLE OILS

BACKGROUND OF THE INVENTION

This invention relates to low density three dimensional non-woven abrasive materials for polishing, machining or otherwise treating the surface of a work piece.

The non-woven abrasive materials with which the invention is concerned are of a known general type including a three dimensional web of non-woven fibers randomly intertwined and carrying abrasive particles some of which are at the surface of the web and others of which are distributed within its interior. Binder material secures the fibers together and bonds the abrasive particles to the fibers, with voids remaining within the web constituting a substantial portion of the total volume of the web.

These prior art non-woven abrasive materials have enjoyed wide scale acceptance for many polishing, grinding and machining purposes, but have had some significant disadvantages in use. For example, when the abrasive material is in the form of a disc driven rotatively in a polishing or grinding operation, conventional discs have tended to "walk" away from a desired point of contact with a work surface, in a manner requiring excessive effort to hold the disc in place and to otherwise control the surface treating operation. Chatter, vibration and irregular oscillation of the tool may further limit the operator's control and disrupt the uniformity of the surface finish.

When the prior art material is utilized to abrade aluminum, it is found that the abraded aluminum metal tends to fuse onto and encapsulate the abrasive particles of the non-woven abrasive material, in a manner preventing the particles from effectively cutting the work surface, thereby adversely affecting the abrading capability of the non-woven abrasive material, many times to the extent of rendering it useless. This encapsulating effect is referred to as "capping" or "loading" in the art, and has greatly limited the usefulness of such non-woven materials for abrading aluminum.

SUMMARY OF THE INVENTION

The present invention provides improvements in non-woven abrasive materials which enable a disc or belt containing abrasive particles of a particular grit size to remove material from a work piece more rapidly and effectively than has been possible in the past with a disc or belt having particles of that size. The abrading operation is performed with less friction at the point of abrasion, resulting in better operator control and comfort. The present invention also provides for a lower surface temperature of the abraded material during the abrading operation, minimizing distortion of the work piece by heat and extending the useful life of the non-woven abrasive material by preventing its premature thermal breakdown.

Of particular importance in working on aluminum or other soft metals is the fact that a disc or belt embodying the invention does not have the above discussed encapsulation problem. The abrasive particles of the non-woven abrasive material do not become coated or encapsulated by aluminum and/or aluminum oxide, and can therefore continue their abrading action over a much longer period of time and much more successfully than in prior similar non-woven abrasive materials. The invention inhibits capping and loading by reducing the grinding temperature and chemically interfering with the formation of oxides of the work material on the abrasive particles.

These results are achieved by applying to the non-woven abrasive material a vegetable oil which has been hydrogenated to a degree causing it to be in solid form at the ambient temperatures at which the non-woven abrasive material will normally be handled when not in use. The hydrogenated vegetable oil coats the fibers, abrasive particles and binder of the non-woven abrasive material at the surface of that material and within its interior. During an abrading operation, the hydrogenated vegetable oil melts to liquid form and in that form lubricates the contact between the abrasive particles and work piece in a manner producing a more efficient cut than if the hydrogenated vegetable oil were not present. The hydrogenated vegetable oil continues to liquify throughout the useful life of the non-woven abrasive material.

Some prior art expedients have included mineral oils and animal fats encapsulated in non-woven abrasive materials and released by the contact pressure between the non-woven abrasive material and the abraded metal. Pressure release of such lubricating media is not time controlled and usually results in all of the lubricant being substantially released during a very short period of time. The sustained release of the hydrogenated vegetable oil of the present invention, on the other hand, assures continuance of the lubricating action for an extended period of time, and during that entire period increases the cutting efficiency and enables the non-woven abrasive material to remove material from the work piece at an increased rate but at a lower temperature. The cooling effect is enhanced by reduced friction and absorption of heat by the hydrogenated vegetable oil, particularly during conversion of the hydrogenated vegetable oil from solid to liquid form, with absorption of the heat of fusion.

Because of the low iodine value (high saturation) of the hydrogenated vegetable oil, the oil is not prone to oxidation, hydrolysis, condensation or other reactivity, and is not likely to cause corrosion or form carbon deposits. Its stability under heat and pressure assures boundary lubrication at the points of abrasive contact. Also, because of the polar nature of these long chain fatty hydrogenated vegetable oils, there is a tendency for them to cling to metal surfaces being abraded, and in that way further reduce the coefficient of friction, providing a smoother cut and longer life. In addition, the boundary layer prevents the formation of metal oxides, allowing the non-woven abrasive material to cut soft metal rather than a harder form of metal oxides.

The hydrogenated vegetable oil can be applied to the non-woven abrasive fibrous web in melted form, to flow into the voids within the interior of the web as a liquid and then be cooled to solid form coating the fibers, abrasive particles and binder within the interior of the non-woven abrasive material. As an alternative, the hydrogenated vegetable oil may be initially placed on an upper surface of the web as a granular solid at ambient temperature, and then be melted by passage through an oven or another heating process to flow into the web as discussed. The hydrogenated vegetable oil may be applied during the manufacture of the non-woven abrasive material or may be applied after its manufacture as a separate process.

In the presently preferred form of the invention, the hydrogenated vegetable oil, after application to the non-woven fibrous material, is covered with a thin coating of a protective resinous plastic binder material or paint or the like acting to encapsulate and initially hold the hydrogenated vegetable oil in place and then gradually break away and expose the hydrogenated vegetable oil for contact with a work surface when the non-woven material is pressed against that surface during an abrading or polishing operation. This final coating is advantageous for many applications of the invention, but in some instances may be omitted.

BRIEF DESCRIPTION OF THE DRAWING

The above and other features and objects of the invention will be better understood from the following detailed description of the typical embodiments illustrated in the accompanying drawing, in which:

FIG. 1 is a fragmentary section through a non-woven abrasive material formed in accordance with the invention;

FIG. 2 is a further enlarged fragmentary section taken near the upper surface of the non-woven abrasive material, on line 2—2 of FIG. 1; and FIG. 3 is a diagrammatic representation of a preferred method of applying the hydrogenated vegetable oil and its coating to the non-woven abrasive.

DETAILED DESCRIPTION OF THE INVENTION

Referring first to FIG. 1, there is illustrated at 10 in that figure a non-woven abrasive material embodying the invention, having a surface 11 (the upper surface as illustrated in FIG. 1) which contacts a work piece during an abrading operation. The non-woven abrasive material may be of any desired shape, for either powered or manual movement relative to a work piece contacted by surface 11 of the non-woven abrasive material, to buff, sand, grind or otherwise machine the work surface. For example, the non-woven abrasive material may be a circular disc adapted to be rotated by a power tool about an axis perpendicular to surface 11 of the non-woven abrasive material, or may be a long strip whose ends are to be bonded together to form an endless belt, or may be rectangular, square or any other convenient shape. Multi-layer abrasive wheels can be built by winding a strip of the abrasive material spirally or by bonding several similar discs of the material together.

The non-woven abrasive material 10 of FIGS. 1 and 2 includes a lofty, very open, three dimensional web of non-woven fibers 13 which are randomly intertwined in a manner interlocking the fibers to form an integrated but highly porous and low density mat. The fibers carry a large number of abrasive particles 14 some of which are adhered to the fibers at the upper surface 11 of the non-woven abrasive material, and many of which particles are distributed within the interior of the fibrous web and adhered to the fibers thereof. A binder material 15 is also contained within the fibrous web, acting to secure the abrasive particles 14 to the fibers at surface 11 and beneath that surface within the interior of the web, and also acting to secure the individual fibers together at points at which they intersect. This binder material 15 preferably coats all of the fibers and all of the particles as illustrated in FIG. 2. The non-woven abrasive material may or may not be reinforced by incorporation of a layer of material 16 into the non-woven abrasive material, typically taking the form of a sheet of loosely woven material serving as a "scrim" secured to the remainder of the non-woven abrasive material near its undersurface 12. This scrim may be attached to the fibrous web by needle tacking some of the fibers downwardly through the scrim as well known in the art.

The portions of the non-woven abrasive material 10 thus far described, including fibers 13, abrasive particles 14, binder 15 and scrim 16, may be the same as any of various three dimensional non-woven abrasive materials currently on the market and widely used in mechanical and manual abrading and buffing operations. Such three dimensional non-woven abrasive materials are manufactured by Minnesota Mining and Manufacturing Co., St. Paul, Minn. under the trademark "SCOTCH BRITE", Norton Company of Worcester, Mass., under the trademark "BEARTEX", and by Freudenberg, Halifax, West Yorkshire, England, and others. Three dimensional non-woven abrasive materials of this type and processes for their manufacture are described in detail in U.S. Pat. Nos. Nos. 2,958,593, 3,401,491, 4,018,575, 4,227,350, 4,609,380, 4,331,453, 3,688,453, 4,802,896, 4,486,200, 4,355,489, 4,314,827 and 4,609,380. It is contemplated that any of the processes described in those patents for producing a fibrous non-woven three dimensional material including fibers, abrasive particles and binder as illustrated at 13, 14 and 15 in FIGS. 1 and 2 may be utilized in producing the portions of the material thus far described in this application. Since this material is old and well known in the art, we will not unduly lengthen the present description by reiterating the teachings of the above mentioned patents, but include those teachings herein by reference.

The novelty of the present invention resides primarily in the application to such a non-woven abrasive material of a thin coating 17 of vegetable oil hydrogenated to solid form and adhered to and covering the fibers 13, abrasive particles 14, and binder material 15. A second thin coating 18 of a protective and retaining material may be superimposed on and cover and adhere continuously to the hydrogenated vegetable oil 17. These two layers 17 and 18 coat the fibers, particles 14 and binder 15 at the upper surface 11 of the non-woven abrasive material and within the interior of the non-woven abrasive material. At most locations, the binder material 15 covers the fibers 13 and abrasive particles 14, and consequently the hydrogenated vegetable oil 17 contacts primarily the binder material.

The hydrogenated vegetable oil is initially introduced into the voids of the fibrous non-woven abrasive material at an elevated temperature above the melting point of the hydrogenated vegetable oil, and then is allowed to cool to ambient temperature within the non-woven abrasive material to form a solid coating on the fibers, abrasive particles, and binder. The vegetable oil is hydrogenated to an extent giving it a melting temperature above any temperature to which the non-woven abrasive material is expected to be subjected in normal handling prior to use. Consequently, the hydrogenated vegetable oil remains in solid form during such handling and until the non-woven abrasive material is placed in use and elevated in temperature by the resultant heat generation and friction of the abrading operation. For this purpose, it is presently thought preferable that the hydrogenated vegetable oil 17 have a melting point of at least about 130° F., desirably between about 130° and 180°, and for best results between about 135° and 150°.

The second layer of material 18 which covers the solid hydrogenated vegetable oil is a substance which cures to solid form and acts to confine the hydrogenated vegetable oil and hold it in place and improve its appearance prior to use. When the composite non-woven abrasive material is placed in contact with and pressed against a work piece, the material of layer 18 is easily cracked by the forces and movement of the abrading operation to progressively release the hydrogenated vegetable oil for contact with the work surface. Layer 18 may be formed of a resinous plastic binder or paint, such as a water based acrylic, epoxy or urethane binder. A presently preferred material for this purpose is the water based acrylic binder sold by Rhom and Haas as "Rhoplex". The layer 18 may typically be between about 50 and 200 microns in thickness and may be applied in any convenient manner, such as by spraying, roll coating or the like, and be cured by air drying or at an elevated temperature in an oven.

The completed non-woven abrasive material 10, after application of the hydrogenated vegetable oil 17 and top coating 18, is still very open and lofty to leave many intercommunicating relatively large voids 19 within the interior of the non-woven abrasive material and extending through its entire thickness. The voids 19 desirably occupy about least about 40 percent of the overall volume of the non-woven abrasive material, varying between about 20 and 70 percent. During use of the non-woven abrasive material in a grinding operation, fibers 13 and the binder 15 may flex to enable some of the abrasive particles 14 which may initially be beneath the exposed surface 11 of the non-woven abrasive material to contact and abrade the surface of a work piece.

The hydrogenated vegetable oil 17 may be any vegetable oil which will remain in solid form within the interstices of the fibrous non-woven abrasive material during normal handling at ambient temperatures. For example, the vegetable oil 17 may be selected from the groups of monoglyceride and/or triglyceride oils with carbon chains greater than ten consisting of castor, coconut, corn, cotton, linseed, mustard, olive, palm, peanut, rapeseed, soybean, sunflower and/or mixtures thereof. In certain instances, it is desired that the vegetable oil be selected from the group consisting of cottonseed oil, palm oil, rapeseed oil, soybean oil and mixtures thereof. A presently preferred mixture includes the first three of these oils in the following proportions, by weight:

| | |
|---|---|
| hydrogenated cottonseed oil | 8 parts |
| hydrogenated palm oil | 20 parts |
| hydrogenated rapeseed oil | 72 parts |

A product of this composition is sold by Eastman Chemical Products, Inc., Eastman Kodak Company of Kingsport, Tenn. under the trademark "MONOSET".

FIG. 3 illustrates diagrammatically a process for applying the hydrogenated vegetable oil 17 and coating 18 onto the non-woven abrasive material of FIGS. 1 and 2. As a strip 25 of the prior art non-woven abrasive material, including fibers 13, abrasive particles 14 and binder 17, advances to the right in FIG. 3, a unit 26 first drops the hydrogenated vegetable oil in solid but finely divided particulate or granular form onto the upper surface of the non-woven abrasive material, as represented at 27. This granular solid material is at ambient temperature, say 70° F., a temperature well below the melting temperature of the hydrogenated vegetable oil, and therefore remains in granular form on the upper surface of the non-woven abrasive material.

The fibrous strip with powdered hydrogenated vegetable oil on its upper surface then advances rightwardly into and through an oven 28, which heats the hydrogenated vegetable oil and three dimensional non-woven abrasive material to a temperature above the melting temperature of the solid granular hydrogenated vegetable oil and thus melts that material causing it to flow by gravity downwardly into the voids of the three dimensional fibrous mass. After the advancing material leaves the right end of oven 28, the non-woven abrasive material is allowed to cool to ambient temperature, say 70° F., solidifying the hydrogenated vegetable oil to the form of the thin layer 17 of FIG. 2 continuously coating the fibers, abrasive particles, and binder at the upper surface 11 of the non-woven abrasive material and within the voids in its interior. The cooled strip 25 is then advanced past a unit 29 which applies the final coating material of layer 18 to the strip 25. This unit 29 is typically illustrated as a sprayer, but may be a roll coating device or any other unit capable of applying the final coating material in liquid form to the upper surface of strip 25, to flow downwardly into the voids of the fibrous mass and be air dried, or cured in an oven 30, to the form of the thin layer 18 illustrated in FIG. 2. The binder may be applied before or after the non-woven abrasive material enters the oven 30. The finished product may then be cut to the shape of a disc, belt, rectangle, or other desired configuration for use as a non-woven abrasive material.

The fibers 13 utilized in the present non-woven abrasive material may be any appropriate synthetic or natural fibers having suitable strength and other characteristics for satisfactory service in an abrading non-woven abrasive material. Synthetic fibers are presently preferred, desirably nylon or a polyester such as that sold by E. I. DuPont De Nemours under the trademark "Dacron". The fibers may be of any convenient length and diameter, typically between about one-half of an inch and four inches in length and between about twenty five and two hundred fifty microns in diameter.

Any known type of abrasive material may be utilized for the particles 14, such as silicon carbide, aluminum oxide, garnet, flint, emery, pumice, topaz, corundum or zirconia, in any appropriate size typically varying from 10 grit to 600 grit (average diameter 0.01 to 2 mm).

As a variational method of applying the hydrogenated vegetable oil and the material 18 into the interior of a non-woven abrasive material including fibers, abrasive particles and binder as represented at 13, 14 and 15 in FIG. 2, it is contemplated that some of the advantages of the invention may be obtained by microencapsulating minute particles of the solid hydrogenated vegetable oil in binder material of the type utilized in coating 18 of FIG. 2, and then introducing these coated particles into the voids in the fibrous mass.

Specific examples further illustrating the invention are set forth below, with the proportions being given by weight.

EXAMPLE 1

An elongated strip 25 of non-woven abrasive material of the type known in the prior art, including fibers 13, abrasive particles 14 and binder 15 as shown in FIG. 2, was advanced rightwardly as shown in FIG. 3 beneath unit 26, which deposited onto the upper surface of the fibrous material hydrogenated vegetable oil in solid granular form represented at 27. The hydrogenated vegetable oil was the product sold by Eastman Chemical Products, Inc. as "Monoset", consisting of 8 percent hydrogenated cottonseed oil, 20 percent hydrogenated palm oil and 72 percent hydrogenated rapeseed oil. The melting temperature of this material is 146° F. The hydrogenated vegetable oil mixture was deposited on the upper surface of the fibrous non-woven abrasive material at about 0.25 gm/cm$^2$, and was then advanced into oven 28, within which the hydrogenated vegetable oil and non-woven abrasive material were heated to a temperature of 300° F. for 1 minute, thereby melting the initially solid granular material 27 and causing it to flow downwardly by gravity into the voids within the fibrous non-woven abrasive material. After leaving oven 28, the melted hydrogenated vegetable oil coating the fibers and other portions of the non-woven abrasive material was allowed to cool to an ambient temperature of 70° F., and thereby solidify to the form of the thin layer 17 of FIG. 2. The final layer 18 of FIG. 2 was not applied to the fibrous mass in this example.

The non-woven abrasive material thus formed was cut to the shape of a disc seven inches in diameter and was tested in an automated testing machine along with another disc which was identical except for the absence of the hydrogenated vegetable oil. Each disc was rotated at a speed of 6000 rpm and while rotating its surface 11 was pressed against a work piece of 6063 aluminum tubing with a force of ten pounds. Each disc made a series of 16 successive grinds on the tube stock. Each grind lasted sixty seconds, and the tube stock was water quenched between grinds. The surface temperature to which the tube stock was raised, and the number of grams of material removed, were measured for each grind.

The surface temperature of the tube stock was in every instance considerably lower for the disc treated with hydrogenated vegetable oil than for the disc not so treated. The disc treated with hydrogenated vegetable oil also had a much higher material removal rate than the disc without hydrogenated vegetable oil. The total number of grams of material removed during the complete test was 47.55 grams for the disc without hydrogenated vegetable oil and 75.65 grams for the disc with hydrogenated vegetable oil. The temperatures and amounts of material removed for the sixteen individual grinds were as follows:

| | Without Monoset | | With Monoset | |
|---|---|---|---|---|
| Grind # (1 minute) | Surface Temperature (fahrenheit) | Material Removed (grams) | Surface Temperature (fahrenheit) | Material Removed (grams) |
| 1 | 354 | 4.65 | 294.5 | 6.45 |
| 2 | 359.5 | 3.85 | 312 | 5.90 |
| 3 | 363.5 | 3.70 | 311 | 5.65 |
| 4 | 364 | 3.40 | 317.5 | 5.60 |
| 5 | 364 | 3.05 | 314.5 | 4.70 |
| 6 | 367 | 2.80 | 315 | 4.85 |
| 7 | 356 | 3.05 | 314 | 4.75 |
| 8 | 365 | 2.85 | 317.5 | 4.85 |
| 9 | 368 | 2.70 | 317 | 4.45 |
| 10 | 363.5 | 2.55 | 323 | 4.40 |
| 11 | 360 | 2.70 | 323.5 | 4.25 |
| 12 | 364 | 2.50 | 327.5 | 4.45 |
| 13 | 361.5 | 2.45 | 332.5 | 3.95 |
| 14 | 365.5 | 2.50 | 332 | 3.95 |
| 15 | 361.5 | 2.4 | 327 | 3.75 |

-continued

| | Without Monoset | | With Monoset | |
|---|---|---|---|---|
| Grind # (1 minute) | Surface Temperature (fahrenheit) | Material Removed (grams) | Surface Temperature (fahrenheit) | Material Removed (grams) |
| 16 | 367.5 | 2.35 | 325 | 3.70 |
| Total grams removed: | | 47.55 | | 75.65 |

EXAMPLE 2

Example 1 was repeated with substitution of hydrogenated soybean oil having a melting temperature of 153° F. for the mixture of hydrogenated vegetable oils used in Example 1. The surface temperature of the work piece was reduced and the amount of material removed per grind was increased as compared with the disc having no hydrogenated vegetable oil, in a manner similar to that discussed in connection with Example 1. The total grams removed for the sixteen grinds was 76.6 grams, as compared with 47.55 grams for the identical disc without hydrogenated vegetable oil.

| | Without Hydrogenated Soybean Oil/ Sunflower Oil | | With Hydrogenated Soybean Oil/ Sunflower Oil | |
|---|---|---|---|---|
| Grind # (1 minute) | Surface Temperature (fahrenheit) | Material Removed (grams) | Surface Temperature (fahrenheit) | Material Removed (grams) |
| 1 | 354 | 4.65 | 287.5 | 8.20 |
| 2 | 359.5 | 3.85 | 300.5 | 6.95 |
| 3 | 363.5 | 3.70 | 299 | 6.80 |
| 4 | 364 | 3.40 | 303.5 | 6.55 |
| 5 | 364 | 3.05 | 308 | 5.35 |
| 6 | 367 | 2.80 | 311.5 | 4.95 |
| 7 | 356 | 3.05 | 307 | 4.90 |
| 8 | 365 | 2.85 | 309.5 | 4.40 |
| 9 | 368 | 2.70 | 309.5 | 4.10 |
| 10 | 363.5 | 2.55 | 314 | 4.00 |
| 11 | 360 | 2.70 | 312.5 | 3.85 |
| 12 | 364 | 2.50 | 318 | 3.55 |
| 13 | 361.5 | 2.45 | 316 | 3.35 |
| 14 | 365.5 | 2.50 | 317.5 | 3.35 |
| 15 | 361.5 | 2.45 | 321 | 3.20 |
| 16 | 367.5 | 2.35 | 317 | 3.10 |
| Total grams removed: | | 47.55 | | 76.60 |

EXAMPLE 3

Example 1 was repeated with substitution of hydrogenated palm oil for the hydrogenated vegetable oil mixture of Example 1. Decreases in temperature and increases in material removed were attained as with the other examples. The total amount of material removed by the sixteen grinds in this example were 77.7 grams.

| | Without Hydrogenated Palm Oil | | With Hydrogenated Palm Oil | |
|---|---|---|---|---|
| Grind # (1 minute) | Surface Temperature (fahrenheit) | Material Removed (grams) | Surface Temperature (fahrenheit) | Material Removed (grams) |
| 1 | 354 | 4.65 | 304 | 8.75 |
| 2 | 359.5 | 3.85 | 309.5 | 7.10 |
| 3 | 363.5 | 3.70 | 309 | 7.00 |
| 4 | 364 | 3.40 | 309 | 6.35 |
| 5 | 364 | 3.05 | 319 | 5.30 |
| 6 | 367 | 2.80 | 317.5 | 4.95 |
| 7 | 356 | 3.05 | 319 | 4.75 |
| 8 | 365 | 2.85 | 321.5 | 4.60 |

-continued

| Grind # (1 minute) | Without Hydrogenated Palm Oil: Surface Temperature (fahrenheit) | Without Hydrogenated Palm Oil: Material Removed (grams) | With Hydrogenated Palm Oil: Surface Temperature (fahrenheit) | With Hydrogenated Palm Oil: Material Removed (grams) |
|---|---|---|---|---|
| 9 | 368 | 2.70 | 323 | 4.30 |
| 10 | 363.5 | 2.55 | 324 | 3.95 |
| 11 | 360 | 2.70 | 326 | 3.70 |
| 12 | 364 | 2.50 | 328 | 3.65 |
| 13 | 361.5 | 2.45 | 329 | 3.50 |
| 14 | 365.5 | 2.50 | 327.5 | 3.40 |
| 15 | 361.5 | 2.45 | 323.5 | 3.20 |
| 16 | 367.5 | 2.35 | 325.5 | 3.20 |
| Total grams removed: | | 47.55 | | 77.70 |

EXAMPLES 4 AND 5

A strip of non-woven abrasive material, including fibers 13, abrasive particles 14 and binder 15 as in FIG. 2, but not identical to the non-woven abrasive material utilized in Examples 1, 2 and 3, was coated with Monoset by the process described in Example 1, and was then further coated with the water-based acrylic binder sold by Rhom and Haas as "Rhoplex", to form the final coating 18 of such binder as shown in FIG. 2. The acrylic binder was sprayed onto the upper surface of the strip by the sprayer represented at 29 in FIG. 3, was allowed to flow downwardly into the interior of the fibrous mass and was then dried to hardened form at a temperature of 150° F. in oven 30 of FIG. 3.

A similar product was made with the same acrylic top coating but with hydrogenated rapeseed oil substituted for the Monoset.

Both of these products were tested in the manner discussed in Example 1, except that each of the sixteen grinds was for a period of only thirty seconds rather than one full minute. An additional sample was tested in the same way and was identical to the other two products except that it did not include either the hydrogenated vegetable oil or acrylic topcoat 18. The total material removed with the sample not having either the hydrogenated vegetable oil or acrylic coating was 33.67 grams. The material removed by the acrylic coated rapeseed sample was 48.80 grams and the material removed by the acrylic coated monoset sample was 50.87. The following chart shows the amounts of material removed by the three samples during each of the sixteen grinds.

| Grind # (30 seconds) | Without Hydrogenated Vegetable Oil or Acrylic Topcoat (grams removed) | Hydrogenated Rapeseed Oil with Acrylic Topcoat (grams removed) | Monoset with Acrylic Topcoat (grams removed) |
|---|---|---|---|
| 1 | 3.90 | 5.70 | 5.93 |
| 2 | 2.63 | 3.73 | 4.07 |
| 3 | 2.53 | 3.60 | 3.80 |
| 4 | 2.33 | 3.10 | 3.50 |
| 5 | 2.10 | 3.00 | 3.07 |
| 6 | 2.10 | 2.73 | 3.13 |
| 7 | 2.00 | 2.97 | 3.03 |
| 8 | 2.03 | 2.80 | 2.83 |
| 9 | 1.90 | 2.93 | 2.77 |
| 10 | 1.87 | 2.70 | 2.70 |
| 11 | 1.09 | 2.83 | 2.80 |
| 12 | 1.70 | 2.60 | 2.67 |

-continued

| Grind # (30 seconds) | Without Hydrogenated Vegetable Oil or Acrylic Topcoat (grams removed) | Hydrogenated Rapeseed Oil with Acrylic Topcoat (grams removed) | Monoset with Acrylic Topcoat (grams removed) |
|---|---|---|---|
| 13 | 1.73 | 2.57 | 2.63 |
| 14 | 1.70 | 2.50 | 2.63 |
| 15 | 1.60 | 2.53 | 2.60 |
| 16 | 1.63 | 2.50 | 2.70 |
| Total material removed | 33.67 | 48.80 | 50.87 |

We claim:

1. A non-woven abrasive material comprising:

a lofty, open, three dimensional web of non-woven fibers randomly intertwined;

abrasive particles carried by said web with at least some of the particles distributed within the interior of the web;

binder material in the web bonding said fibers together and bonding said abrasive particles to the fibers;

said web containing voids constituting a substantial portion of the volume of the three dimensional web; and hydrogenated vegetable oil in solid form coating said fibers, particles and binder material at the surface of the web and within said voids.

2. A non-woven abrasive material as recited in claim 1, including a protective coating covering said solid form hydrogenated vegetable oil at the surface of the web and within said voids and adapted to be broken by forces encountered during an abrading operation to expose the hydrogenated vegetable oil for contact with a work surface.

3. A non-woven abrasive material as recited in claim 2, in which said protective coating is a resinous plastic binder.

4. A non-woven abrasive material as recited in claim 1, in which said hydrogenated vegetable oil has a melting point of at least about 130° F.

5. A non-woven abrasive material as recited in claim 1, in which said hydrogenated vegetable oil has a melting point between about 130° F. and 180° F.

6. A non-woven abrasive material as recited in claim 1, in which said hydrogenated vegetable oil has a melting point of about 146° F.

7. A non-woven abrasive material as recited in claim 1, in which said hydrogenated vegetable oil is selected from the group consisting of cottonseed oil, palm oil, rapeseed oil, soybean oil, and mixtures thereof.

8. A non-woven abrasive material as recited in claim 2, in which said hydrogenated vegetable oil is selected from the group consisting of cottonseed oil, palm oil, rapeseed oil, soybean oil, and mixtures thereof.

9. A non-woven abrasive material as recited in claim 1, in which said hydrogenated vegetable oil consists essentially of a mixture of cottonseed oil, palm oil and rapeseed oil.

10. A non-woven abrasive material as recited in claim 1, in which said hydrogenated vegetable oil consists essentially of the following oils in about the specified proportions by weight:

| | |
|---|---|
| hydrogenated cottonseed oil | 8 parts |
| hydrogenated palm oil | 20 parts |
| hydrogenated rapeseed oil | 72 parts. |

11. A non-woven abrasive material as recited in claim 10, in which said hydrogenated vegetable oil has a melting temperature of at least about 130° F.

12. A non-woven abrasive material as recited in claim 4, including a protective coating covering said solid form hydrogenated vegetable oil at the surface of the web and within said voids and adapted to be broken by forces encountered during an abrading operation to expose the hydrogenated vegetable oil for contact with a work surface.

13. A non-woven abrasive material as recited in claim 8, including a protective coating covering said solid form hydrogenated vegetable oil at the surface of the web and within said voids and adapted to be broken by forces encountered during an abrading operation to expose the hydrogenated vegetable oil for contact with a work surface.

14. A non-woven abrasive material as recited in claim 12, in which said protective coating is a resinous plastic binder.

15. A non-woven abrasive material as recited in claim 10, including a protective coating of resinous plastic binder covering said solid form hydrogenated vegetable oil at the surface of the web and within said voids.

16. The method that comprises:

applying hydrogenated vegetable oil to a lofty, open, three dimensional web of non-woven fibers carrying abrasive particles at least some of which are distributed within the interior of the web, with binder material bonding said fibers together and bonding said particles to the fibers;

flowing some of said hydrogenated vegetable oil in melted form into voids within said web; and cooling said hydrogenated vegetable oil to solid form coating said fibers, particles and binder material at the surface of the web and within said voids.

17. The method as recited in claim 16, in which said hydrogenated vegetable oil is melted at a temperature of at least about 130° F.

18. The method as recited in claim 16, in which said hydrogenated vegetable oil is selected from the group consisting of cottonseed oil, palm oil, rapeseed oil, soybean oil, and mixtures thereof.

19. The method as recited in claim 16, including coating said hydrogenated vegetable oil at the surface of the web and within said voids with a protective layer adapted to be broken by forces encountered during an abrading operation.

20. The method as recited in claim 19, in which said protective layer is formed of a resinous plastic binder material.

21. The method that comprises:

applying hydrogenated vegetable oil in granular solid form to a surface of a lofty, open, three dimensional web of non-woven fibers carrying abrasive particles at least some of which are distributed within the interior of the web, with binder material bonding said fibers together and bonding said abrasive particles to the fibers;

heating said granular hydrogenated vegetable oil to melting temperature and thereby converting it to liquid form;

flowing some of said melted hydrogenated vegetable oil into voids within said web; and cooling said hydrogenated vegetable oil to solid form coating said fibers, particles and binder material at the surface of the web and within said voids.

22. The method as recited in claim 21, including coating said hydrogenated vegetable oil at the surface of the web and within said voids with a protective layer adapted to be broken by forces encountered during an abrading operation.

23. The method as recited in claim 21, in which said hydrogenated vegetable oil is melted at a temperature of at least about 130° F.

24. The method as recited in claim 21, in which said hydrogenated vegetable oil is selected from the groups of monoglyceride and/or triglyceride oils with carbon chains greater than ten consisting of cottonseed oil, palm oil, rapeseed oil, soybean oil and mixtures thereof.

25. The method as recited in claim 24, including a coating of resinous plastic binder material covering said solid form hydrogenated vegetable oil at the surface of the web and within its interior.

26. The method that comprises:

applying hydrogenated vegetable oil in granular solid form to the upper surface of a lofty, open, three dimensional web of non-woven fibers carrying abrasive particles at least some of which are distributed within the interior of the web, with binder material bonding said fibers together and bonding said abrasive particles to the fibers;

heating said granular hydrogenated vegetable oil to melting temperature and thereby converting it to liquid form;

flowing some of said melted hydrogenated vegetable oil downwardly by gravity into voids within said web; and cooling said hydrogenated vegetable oil to solid form coating said fibers, particles and binder material at the upper surface of the web and within said voids.

* * * * *